US010584836B1

(12) United States Patent
Li

(10) Patent No.: US 10,584,836 B1
(45) Date of Patent: Mar. 10, 2020

(54) UNIFORMLY ILLUMINATING LED LIGHT STRIP

(71) Applicant: GUANGDONG OML TECHNOLOGY CO., LTD, Zhongshan, Guangdong (CN)

(72) Inventor: Xiaoping Li, Guangdong (CN)

(73) Assignee: GUANGDONG OML TECHNOLOGY CO., LTD, Zhongshan (CN)

( * ) Notice: Subject to any disclaimer, the term of this patent is extended or adjusted under 35 U.S.C. 154(b) by 0 days.

(21) Appl. No.: 16/263,077

(22) Filed: Jan. 31, 2019

(51) Int. Cl.

| | |
|---|---|
| ***F21S 4/28*** | (2016.01) |
| ***F21V 29/50*** | (2015.01) |
| ***F21V 13/04*** | (2006.01) |
| *F21Y 115/10* | (2016.01) |

(52) U.S. Cl.
CPC ..... *F21S 4/28* (2016.01); *F21V 13/04* (2013.01); *F21V 29/50* (2015.01); *F21Y 2115/10* (2016.08)

(58) Field of Classification Search
CPC .. F21S 4/28; F21V 13/04; F21V 29/50; F21Y 2115/10
See application file for complete search history.

(56) References Cited

U.S. PATENT DOCUMENTS

| | | | | |
|---|---|---|---|---|
| 2014/0092609 | A1* | 4/2014 | Moshtagh | F21V 31/005 362/373 |
| 2015/0345743 | A1* | 12/2015 | Trincia | F21V 7/0091 362/223 |
| 2016/0091179 | A1* | 3/2016 | Jiang | F21V 19/009 362/218 |
| 2017/0202061 | A1* | 7/2017 | Allen | F21S 4/10 |
| 2017/0221396 | A1* | 8/2017 | Bertlwieser | F21V 19/0015 |
| 2018/0187868 | A1* | 7/2018 | Dankelmann | F21V 21/005 |
| 2019/0093870 | A1* | 3/2019 | Liu | F21V 25/00 |
| 2019/0120460 | A1* | 4/2019 | Pelka | F21V 5/04 |

* cited by examiner

*Primary Examiner* — Bao Q Truong
*Assistant Examiner* — Glenn D Zimmerman

(57) ABSTRACT

The invention discloses a uniformly illuminating LED light strip, comprising an outer casing, an inner casing, and a light-emitting component, the outer casing comprises a light-transmitting layer and a reflective layer, the reflective layer is disposed on two sides of the light-transmitting layer and extends to the bottom of the light-transmitting layer, the light-transmitting layer is provided with a vacant part, the light emitted by the LED illuminant is refracted by the vacant part and then emitted through the light-exiting surface of the light-transmitting layer. In the present invention, the light of both large-angle and the small-angle emitted by the LED illuminant is reflected and refracted by the mutual cooperation of the vacant part and the reflective layer, and finally emitted through the light-exiting surface of the light-transmitting layer making the light of the light strip more uniform and improving the decoration and lighting effect of the light strip.

9 Claims, 3 Drawing Sheets

UNIFORMLY ILLUMINATING LED LIGHT STRIP

FIELD OF THE INVENTION

The present invention relates to the field of lighting technology, particularly to a uniformly illuminating LED light strip.

BACKGROUND OF THE INVENTION

Because of its characteristics of soft, light, pure color and easy installation, LED light strips are widely used in decoration of building contours, steps, booths, bridges, hotels, KTV decorative lighting, advertising signs, advertising designs for animations, scripts and paintings, and so on.

Since the light of a LED chip on a LED light is directly emitted in the prior art, the LED chip can be seen from the light emitting surface of the light strip and the light at the center of the LED chip is brighter than the light at other positions, which affect the decoration and lighting effects.

SUMMARY OF THE INVENTION

A technical problem to be solved by the present invention is to provide a uniformly illuminating LED light strip which is cost-effective and suitable for decoration and lighting.

A technical problem to be solved by the present invention is to provide a uniformly illuminating LED light strip of good heat dissipation.

A technical problem to be solved by the present invention is to provide a uniformly illuminating LED light strip which is safe and durable for use.

In order to solve above technical problems, the present invention provides a uniformly illuminating LED light strip comprising an outer casing, an inner casing disposed within the outer casing, and a light-emitting component disposed within the inner casing, wherein the light-emitting component includes a substrate and at least one LED illuminant disposed on the substrate, the outer casing comprises a light-transmitting layer and a reflective layer, the reflective layer is located on both sides of the light-transmitting layer and extends to the bottom of the light-transmitting layer, a vacant part is disposed in the light-transmitting layer along its length direction, the light emitted by the LED illuminant is refracted by the vacant part and then exits through the light-exiting surface of the light-transmitting layer, the refractive index of the light-transmitting layer is 1.12-1.32 times that of the vacant part, and the thickness of the light-transmitting layer is 0.17-0.35 times that of the outer casing.

Preferably, the vacant part is filled with carbon dioxide and/or nitrogen gas.

Preferably, the cross-sectional area of the vacant part is 10% to 60% of the cross-sectional area of the light-transmitting layer.

Preferably, the reflective layer comprises a first reflective layer and a second reflective layer, the first reflective layer is set on both sides of the light-transmitting layer, and the second reflective layer is on the bottom of the light-transmitting layer.

Preferably, the reflectivity of the first reflective layer is 1.25-1.63 times that of the second reflective layer.

Preferably, the thickness of the first reflective layer is less than that of the light-transmitting layer, the expansion coefficient of the light-transmitting layer is greater than that of the first reflective layer.

Preferably, a cavity is disposed in the inner casing along its length direction, the light-emitting component is set in the cavity, a toothed strip is disposed on a sidewall facing a LED illuminant of the cavity, the light emitted by the LED illuminant is refracted by the toothed strip.

Preferably, a slot is disposed on a sidewall of the cavity, a side edge of the substrate is locked in the slot for fixing the substrate in the cavity.

Preferably, the light-emitting component further comprises two conductive strips, the conductive strips are disposed on both sides of the LED illuminant.

Preferably, the conductive strip is a copper wire or a copper plate and fixed on the substrate by soldering.

The implementation of the present invention has the following advantages.

1. The present invention provides a uniformly illuminating LED strip comprising an outer casing, an inner casing disposed within the outer casing, and a light-emitting component disposed within the inner casing, wherein the light-emitting component includes a substrate and at least one LED illuminant disposed on the substrate, the outer casing comprises a light-transmitting layer and a reflective layer, the reflective layer is disposed on two sides of the light-transmitting layer and extends to the bottom of the light-transmitting layer, the light-transmitting layer is provided with a vacant part along the length thereof, the light emitted by the LED illuminant is refracted by the vacant part and then exits through the light-exiting surface of the light-transmitting layer. In the present invention, the light of both large-angle and small-angle light emitted by the LED illuminant is reflected and refracted by the mutual cooperation of the vacant part and the reflective layer, and finally exited through the light-exiting surface of the light-transmitting layer, making the light of the light strip more uniform and improving the decoration and lighting effect of the light strip.

2. The present invention provides a uniformly illuminating LED strip, wherein the reflective layer comprises a first reflective layer and a second reflective layer, the first reflective layer is set on both sides of the light-transmitting layer, and the second reflective layer is on the bottom of the light-transmitting layer, wherein the reflectivity of the first reflective layer is greater than that of the second reflective layer. In the present invention, both large-angle and small-angle light emitted by the LED illuminant is reflected and refracted by the mutual cooperation of the vacant part, the first reflective layer and the second reflective layer, and finally exited through the light-exiting surface of the light-transmitting layer, making the light of the light strip more uniform and improving the decoration and lighting effect of the light strip.

3. The invention provides a uniformly illuminating LED light strip, wherein the vacant part is filled with carbon dioxide and/or nitrogen gas, since both the refractive index and the thermal conductivity of carbon dioxide and nitrogen gas are greater than that of air, the vacant part filled with carbon dioxide and/or nitrogen improve the heat dissipation effect and light uniformity of the light strip.

4. The invention provides a uniformly illuminating LED strip, wherein the cavity is provided with a toothed strip on the sidewall of the LED illuminant, and the light emitted by the LED illuminant is refracted by the tooth stripe making the light of the strip more uniform, therefore, when the light emitted by the light strip is projected onto the object, the color is uniform avoiding discoloration or spotting when the light strip lights up, so that the overall appearance of the strip is more beautiful.

5. The invention provides a uniformly illuminating LED strip, wherein the substrate is provided with a conductive strip for forming an electrical connection between the external power source and the substrate. When installing, it is only necessary to install the substrate in the inner casing which is labor saving, allowable for automatic production and efficient.

DETAILED DESCRIPTION OF ILLUSTRATED EMBODIMENTS

To better illustrate the present invention in aspects of the objective, technical scheme and advantages, the present invention is further described in detail with reference to the accompanying drawings.

Figure 1:
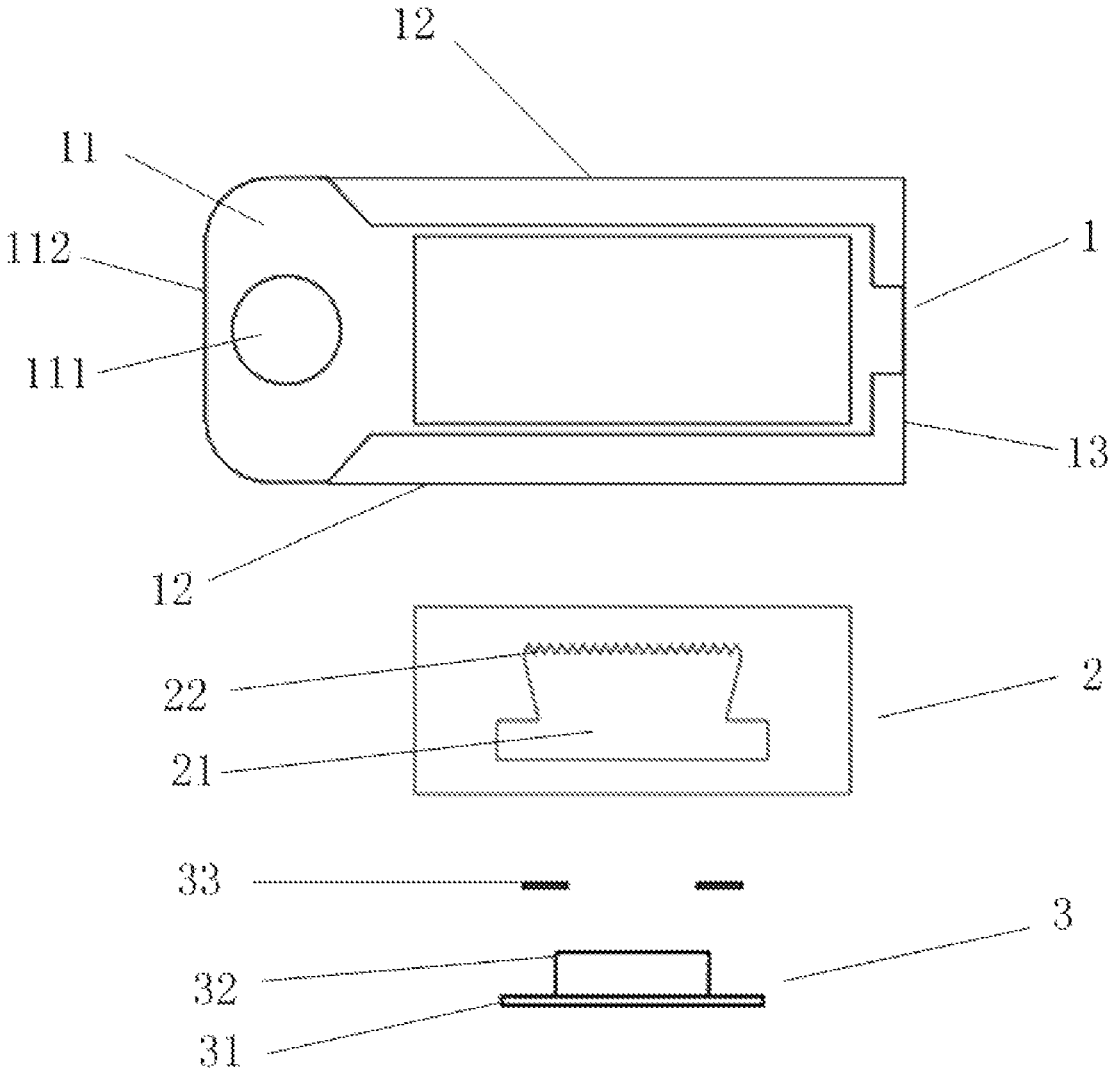
FIG. 1 shows a exploded view of an LED light strip of the present invention.
Figure 2:
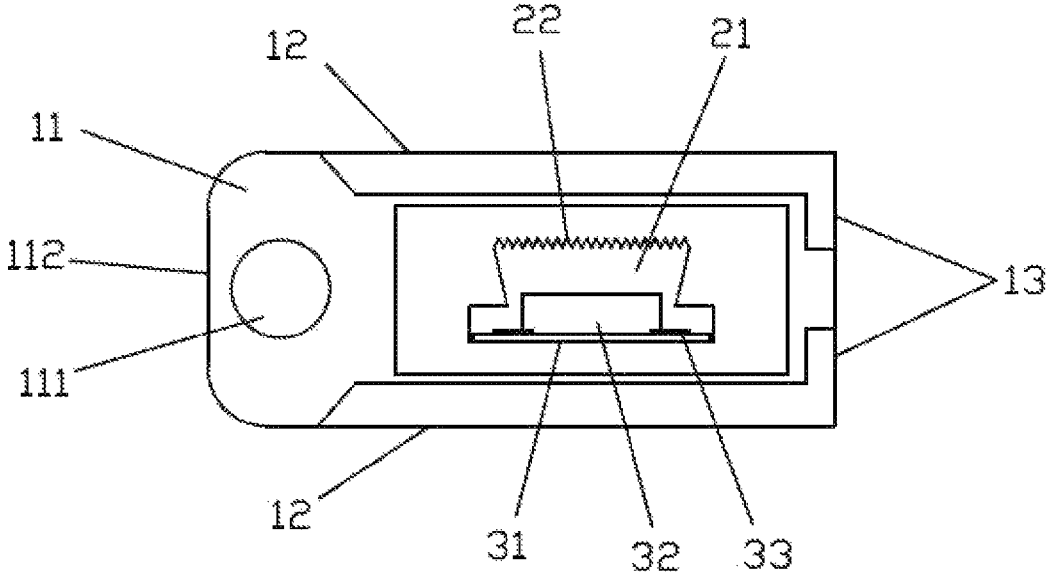
FIG. 2 shows a sectional view of an LED light strip of the present invention.
Figure 3:
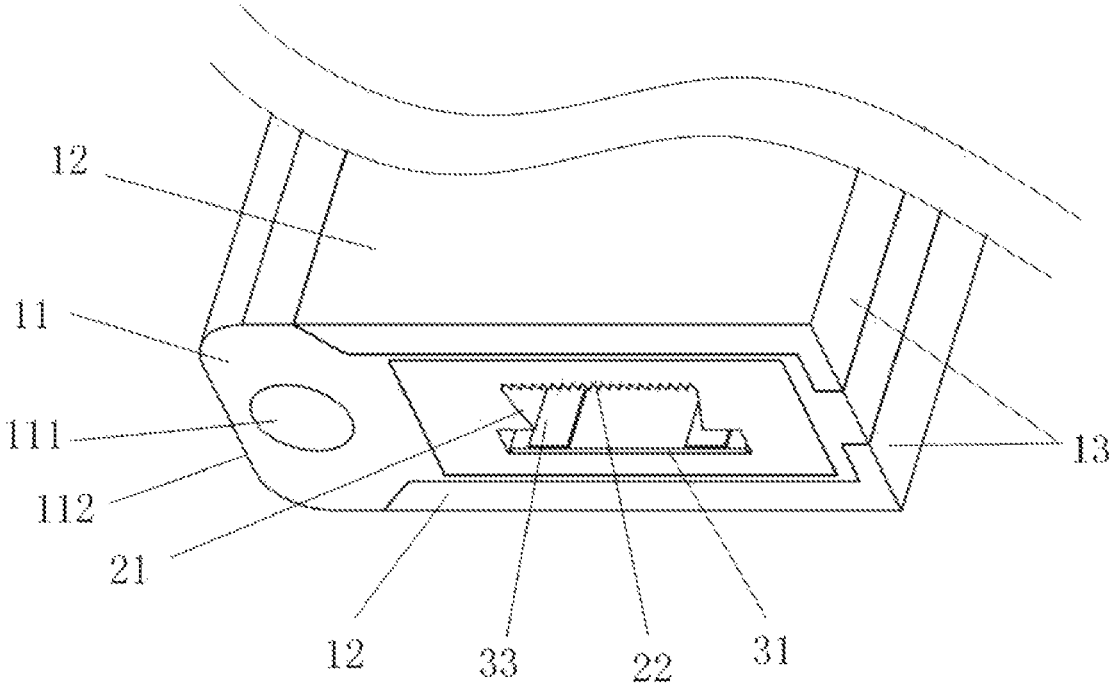
FIG. 3 shows a stereogram of an LED light strip of the present invention.

Referring to FIG. 1 to FIG. 3, the present invention provided a uniformly illuminating LED strip, comprising an outer casing 1, an inner casing 2 disposed in the outer casing 1, and a light-emitting component disposed in the in casing 2. The light-emitting component comprised a substrate 31 and at least one LED illuminant 32 disposed on the substrate 31. The outer casing 1 comprised a light-transmitting layer 11 and a reflective layer, and the reflective layer was located on two sides of the light-transmitting layer 11 and extended to the bottom of the light-transmitting layer. The light-transmitting layer 11 was provided with a vacant part 111 along the longitudinal direction thereof, and the light emitted by the LED illuminant 32 was refracted by the vacant part 111 and then exited through a light-exiting surface 112 of the Light-transmitting layer 11 the refractive index of the light-transmitting layer 11 is 1.12-1.32 times that of the cavity.

Specifically, when the refractive index of the light-transmitting layer 11 was less than 1.12 times of the refractive index of the vacant part 111, the refraction effect of the vacant part was not obvious, and the light strip would not be effectively illuminating uniformly; when the refraction index of the light-transmitting layer 11 was greater than 1.32 times of the refractive index of 111 of the vacant part, the light was likely to be totally reflected, and the light strip would not be effectively illuminating uniformly either. Only in the range of 1.12 to 1.32, the light could be uniformly emitted.

Since the light emitted by the LED illuminant 32 needs to be refracted by the vacant part 111 and then emitted through the light-exiting surface 112 of the light-transmitting layer 11, the thickness of the light-transmitting layer 11 was 0.17-0.35 times that of the outer casing 1 in order to guarantee the light uniformity and the luminous efficiency of the light strip. When the thickness of the light-transmitting layer 11 was less than 0.17 times the thickness of the outer casing 1, the light could not be effectively refracted, which affected the uniformity of the light emitted by the light strip; when the thickness of the light-transmitting layer 11 was greater than 0.35 times the thickness of the outer casing 1, the light extraction efficiency of the light strip was reduced.

In order to further improve the light uniformity of the light strip and improve the heat dissipation effect of the light strip at the same time, the vacant part 111 was filled with carbon dioxide and/or nitrogen gas. Since both the refractive index and the thermal conductivity of carbon dioxide and nitrogen gas are higher than that of air, the vacant part 111 filled with carbon dioxide and/or nitrogen gas improved the heat dissipation effect and illuminating uniformity of the light strip.

A cross-sectional shape of the vacant part 111 of the present invention was circular, elliptical, triangular, star-shaped or rectangular, but was not limited thereto. The cross-sectional area of the vacant part 111 was 10% to 60% of the cross-sectional area of the light-transmitting layer 11. When the cross-sectional area of the vacant part 111 was less than 10% of the cross-sectional area of the light-transmitting layer 11, it was difficult for the vacant part 111 to effectively refract the light, and the light emitted by the light strip was not uniform; when the vacant part 111 had a larger cross-sectional area than 60% of the cross-sectional area of the light-transmitting layer 11, the supporting strength of the light-transmitting layer 11 was dropped, so that the outer casing 1 was liable to collapse and affect the appearance of the light strip. Preferably, the cross-sectional area of the vacant part 111 was 20%-50% of the cross-sectional area of the light-transmitting layer 11. More preferably, the cross-sectional area of the vacant part 111 was 25% to 45% of the cross-sectional area of the light-transmitting layer 11.

The reflective layer included a first reflective layer 12 and a second reflective layers 13. The first reflective layer 12 was disposed on two sides of then the light-transmitting layer 11, and the second reflective layer 13 was disposed on the bottom of the light-transmitting layer 11, that is, the second reflective layer 13 connected the two opposing first reflective layers 12.

In order to save material and reduce cost without affecting the light uniformity and light extraction efficiency of the light strip, the thickness of the first reflective layer 12 was smaller than the thickness of the light-transmitting layer 11. Since the light strip undergone thermal expansion and contraction under different temperature conditions, in order to prevent cracks in the light strip and to prevent moisture from entering, the expansion coefficient of the light-transmitting layer was greater than that of the first reflective layer.

The light-transmitting layer 11 of the present invention was made of a light-transmitting material, and the reflective layer was made of a reflective material, wherein the light-transmitting material had a expansion coefficient greater than that of the reflective material. Specifically, the light-transmitting layer 11 and the reflective layer of the outer casing 1 were of a unitary structure, and the light-transmitting layer 11 and the reflective layer could be formed into a unitary structure by heat welding or multi-color co-extrusion.

In order to facilitate the production and processing of the outer casing 1, it is further preferred that the light-transmitting layer 11 was a transparent silicone sleeve, and the reflective layer was a reflective silicone panel. Therefore, the light-transmitting layer 11 and the reflective layer could be integrally processed by extrusion molding, and then the reflective silicone panel was subjected to reflection treatment so that the silicone panel is reflective.

Preferably, the reflectivity of the first reflective layer 12 was greater than the reflectivity of the second reflective layer 13, and the light emitted by the LED illuminant 32 was reflected by reflective layers of different reflectivity to have more uniform light emission. Preferably, the reflectivity of the first reflective layer 12 is 1.25-1.63 times that of the second reflective layer 13.

A light-emitting surface of the LED illuminant 32 faced the first reflective layer 12 of the outer casing 1. After the light of a small-angle emitted by the LED illuminant 32 was repeatedly reflected by the first reflective layer 12, part of the light was refracted by the vacant part 111 and emitted through the light-exiting surface 112 of the light-transmitting layer 11 facilitating the diffusion and uniformity of light, and part of the light was directly emitted through the light-exiting surface 112 of the light transmitting layer 11. When the LED illuminant 32 emitted the light of a large angle, part of the light was reflected by the second reflected layer 13 and then emitted through the light-exiting surface 112 of the light-transmitting layer 11, and part of the light was directly emitted through the light-exiting surface 112 of the light-transmitting layer 11.

In the present invention, both the large-angle light and the small-angle light emitted by the LED illuminant 32 were reflected and refracted by the mutual cooperation of the vacant part 111, the first reflective layer 12 and the second reflective layer 13, and finally emitted through the light-exiting surface 112 of the light-transmitting layer 11 making the lighting of the light strip more uniform and improving the decoration and lighting effect of the light strip. In addition, the light-emitting surface of the LED illuminant 32 of the present invention directly faced the first reflective layer 12 instead of the light-exiting surface 112, so that the light emitted by the light strip was softer, the LED illuminant 32 and the substrate 31 would not be seen directly thus providing a more pleasing appearance of the light stripe.

The inner casing 2 of the present invention was provided with an cavity 21 along its longitudinal direction, and the light-emitting component was disposed in the cavity 21. A slot was set in a sidewall of the cavity 21, and a side edge of the substrate 31 was locked in the slot for fixing the substrate 31 in the cavity 21.

In order to improve the luminous efficiency and the light uniformity of the light strip, a sidewall of the cavity 21 facing the LED illuminant 32 was provided with a toothed stripe 22, and the light emitted by the LED illuminant 32 was refracted by the tooth stripe 22, so that a light emitting angle was wider, then the large-angle light and the small-angle light emitted by the LED illuminant 32 were reflected and refracted by the mutual cooperation of the vacant part 111, the first reflective layer 12 and the second reflective layer 13 making the light emitted more uniform, so that the color of the light emitted by the light strip was uniform when projected onto the object, thereby avoiding discoloration or spotting when the light strip turned on, so that the light strip would be more pleasing to the eye.

Preferably, many toothed strips 22 were disposed on the sidewall of the cavity 21, and the toothed strips 22 were uniformly disposed along the sidewall of the cavity 21. More preferably, the toothed strip 22 was straight, and many straight strips were arranged in parallel along the length direction of the outer casing 1. Of course, the toothed strip 11 could be provided in other shapes, such as S-shaped apart from being straight. Besides, the cross-sectional shape of the toothed strip 11 was triangular, wavy or semi-circular, but was not limited thereto.

In order to save labor, carry out automated production, and improve production efficiency, the substrate 31 was provided with a conductive strip 33 for electrically connecting the external power source to the substrate 31. The conductive strip 33 was a copper wire or a copper plate, but was not limited thereto. In the present invention, the conductive strips 33 may also be made of other conductive metals. The conductive strip 33 was fixed to the substrate 31 by soldering and thus was integrated with the substrate 31 in structure. When mounting, it is only necessary to mount the substrate 31 in the inner casing 2. The previous method requires manual insertion of the copper wire into the inner casing 2 to form an electrically conductive connection with the substrate 31, which is inefficient in production.

Specifically, the substrate 31 was a flexible circuit board, and the substrate 31 was provided with many LED illuminants 32. The LED illuminants 32 were convex on the substrate 31 and arranged in a row. The inner casing 2 was encapsulated by injection molding to enclose the light-emitting component.

Figure 4:
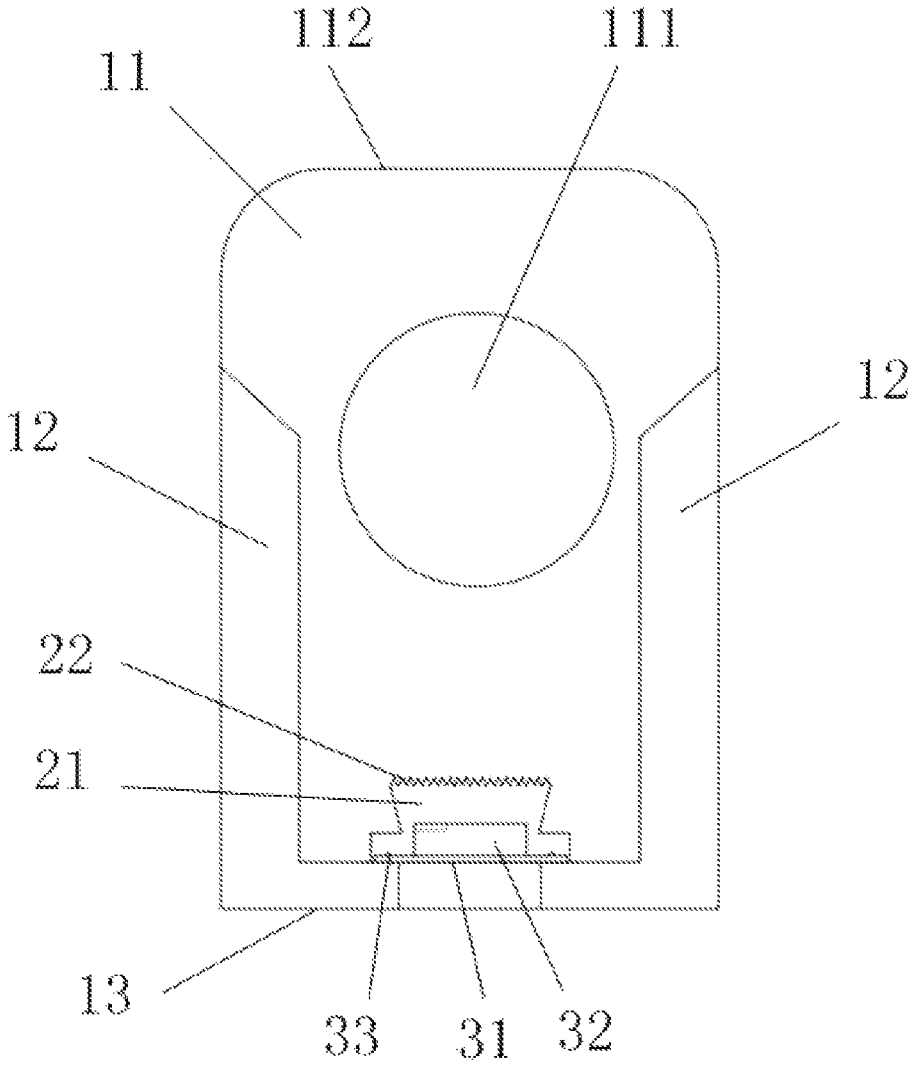
FIG. 4 shows a sectional view of another LED light strip of the present invention.

Referring to FIG. 4, FIG. 4 is a cross-sectional view showing another embodiment of the LED light strip of the present invention. The light-emitting surface of the LED illuminant 32 faced the vacant part 111 of the light transmitting layer 11, and the light of a small-angle emitted by the LED illuminant 32 was refracted by the vacant part 111. Part of the light exited through the light-exiting surface 112 of the light-transmitting layer 11, and part of the light was reflected by the first reflective layer 12 and then exited through the light-exiting surface 112 of the light-transmitting layer 11, which facilitate the light diffusion. After the light of a large-angle emitted by the LED illuminant 32 was repeatedly reflected by the first reflective layer 12, part of the light was refracted by the vacant part 111 and exited from the light-exiting surface 112 of the light transmitting layer 11, part of the light was directly exited through the light-exiting surface 112 of the light transmitting layer 11.

In the embodiment, the light of both large-angle and small-angle emitted by the LED illuminant 32 were reflected and refracted by the mutual cooperation of the vacant part 111, the first reflective layer 12, and the second reflective layer 13, and finally exited from the light-exiting surface 112 of the light-transmitting layer 11, making the light of the light strip more uniform and improving the decoration and lighting effect of the light strip.

The above disclosure is only a preferred embodiment of the present invention, and of course, the scope of the present invention is not limited thereto, and thus equivalent changes made in accordance with the claims of the present invention are still within the scope of the present invention.

What is claimed is:

1. A uniformly illuminating LED light strip, wherein the LED light strip comprises an outer casing, an inner casing disposed in the outer casing, and a light-emitting component disposed in the inner casing, wherein the light-emitting component comprises a substrate and at least one LED illuminant disposed on the substrate, the outer casing comprises a light-transmitting layer and a reflective layer, the reflective layer is disposed on two sides of the light-transmitting layer and extends to the bottom of the light-transmitting layer, the light-transmitting layer is provided with a vacant part along a direction of its length, a light emitted by the LED illuminant is refracted by the vacant part and then exit through a light-exiting surface of the light-transmitting layer, a refractive index of the light-transmitting layer is 1.12-1.32 times that of the vacant part, and a thickness of the light-transmitting layer is 0.17-0.35 times that of the outer casing;

a cavity is disposed in the inner casing along its length direction, the light-emitting component is set in the cavity, a toothed strip is disposed on a sidewall of the cavity facing the LED illuminant, the light emitted by the LED illuminant is refracted by the toothed strip.

2. The uniformly illuminating LED light strip according to claim 1, wherein the vacant part is filled with carbon dioxide and/or nitrogen gas.

3. The uniformly illuminating LED light strip according to claim 1, wherein the reflective layer comprises a first reflective layer and a second reflective layer, the first reflective layer is set on both sides of the light-transmitting layer, the second reflective layer is on the bottom of the light-transmitting layer.

4. The uniformly illuminating LED light strip according to claim 1, a slot is disposed on a sidewall of the cavity, a side edge of the substrate is locked in the slot for fixing the substrate in the cavity.

5. The uniformly illuminating LED light strip according to claim 1, the light-emitting component further comprises two conductive strips, the conductive strips are disposed on the substrate and on both sides of the LED illuminant.

6. The uniformly illuminating LED light strip according to claim 2, wherein a cross-sectional area of the vacant part is 10% to 60% of a cross-sectional area of the light-transmitting layer.

7. The uniformly illuminating LED light strip according to claim 3, a reflectivity of the first reflective layer is 1.25-1.63 times that of the second reflective layer.

8. The uniformly illuminating LED light strip according to claim 5, the conductive strip is a copper wire or a copper plate, and the conductive strip is fixed to the substrate by soldering.

9. The uniformly illuminating LED light strip according to claim 7, a thickness of the first reflective layer is less than that of the light-transmitting layer, an expansion coefficient of the light-transmitting layer is greater than that of the first reflective layer.

* * * * *